US007384505B2

(12) United States Patent
Zoller et al.

(10) Patent No.: US 7,384,505 B2
(45) Date of Patent: Jun. 10, 2008

(54) METHOD OF MANUFACTURING A HYGIENE PAPER PRODUCT, APPARATUS FOR SUCH MANUFACTURE AND HYGIENE PAPER PRODUCT

(75) Inventors: Gunther Zoller, Schriesheim (DE); Bernhard Reichling, Speyer (DE)

(73) Assignee: SCA Hygiene Products GmbH, Mannheim (DE)

( * ) Notice: Subject to any disclaimer, the term of this patent is extended or adjusted under 35 U.S.C. 154(b) by 535 days.

(21) Appl. No.: 10/976,868

(22) Filed: Nov. 1, 2004

(65) Prior Publication Data

US 2005/0153100 A1 Jul. 14, 2005

Related U.S. Application Data

(60) Provisional application No. 60/515,431, filed on Oct. 30, 2003.

(51) Int. Cl.
*D21H 27/30* (2006.01)
*D21H 19/66* (2006.01)
*B31F 1/07* (2006.01)

(52) U.S. Cl. ..... 162/117; 162/114; 162/134; 162/135; 162/362; 428/131; 428/211.1

(58) Field of Classification Search ..... 162/109–117, 162/134, 361, 362, 205–207, 135–137; 428/152–156, 428/131, 211.1, 172, 174; 283/117; 101/23, 101/32; 156/209, 277
See application file for complete search history.

(56) References Cited

U.S. PATENT DOCUMENTS 3,594,552 A 7/1971 Adamson et al.
4,320,162 A * 3/1982 Schulz ..... 428/154
5,123,343 A 6/1992 Willer
5,779,965 A * 7/1998 Beuther et al. ..... 264/280
6,106,928 A * 8/2000 Laurent et al. ..... 428/152
6,395,133 B1 * 5/2002 McNeil ..... 162/132
6,413,614 B1 * 7/2002 Giesler et al. ..... 428/156
6,983,686 B2 * 1/2006 Vaughn et al. ..... 101/32

FOREIGN PATENT DOCUMENTS

| | | |
|---|---|---|
| EP | 1 304 215 | 4/2003 |
| GB | 2 036 649 | 7/1980 |
| WO | WO 97 35695 | 10/1997 |
| WO | WO 99 38679 | 8/1999 |

* cited by examiner

*Primary Examiner*—Eric Hug
(74) *Attorney, Agent, or Firm*—Young & Thompson

(57) ABSTRACT

Method and apparatus for manufacturing a hygiene paper product includes: providing a continuous paper web, moving the continuous web in the direction of its longitudinal extension, applying a repetitive creative structure relative to the longitudinal extension of the web as a first pattern to the web with a first roll, applying a repetitive functional structure relative to the longitudinal extension of the web as a second pattern to the web with a second roll, while enabling the first pattern to be in register with the second pattern by concurrently controlling the repetitive surface speed of continuous web and the phasing between the first roll and the second roll.

12 Claims, 5 Drawing Sheets

PRIOR ART

METHOD OF MANUFACTURING A HYGIENE PAPER PRODUCT, APPARATUS FOR SUCH MANUFACTURE AND HYGIENE PAPER PRODUCT

CROSS REFERENCE TO RELATED APPLICATION

This application claims the 35 USC 119(e) benefit of prior Provisional application 60/515,431 filed on 30 Oct. 2003.

FIELD OF THE INVENTION

The present invention relates to a method of manufacture of hygiene paper products having a decorative structure and a functional structure, as well as an apparatus for such manufacture and the respective hygiene paper products.

A decorative structure in the sense of the present invention includes any kind of treatment that imparts an aesthetically pleasing pattern to the hygiene product. That is, the decorative structure is applied to the hygiene product for design purposes. A typical decoration element is a print on at least one surface of a hygiene paper product.

In contrast, functional structures serve to improve the properties of the hygiene paper product, that is the functional structure may improve the product thickness, absorbency, bulk softness, etc. A typical functional element is embossing.

The hygiene paper product may be made of tissue paper or a non-woven.

A tissue paper is defined as a soft absorbent paper having a low basis weight. One generally selects a basis weight of 8 to 30 g/m2, especially 10 to 25 g/m2 per ply. The total basis weight of multiple-ply tissue products is preferably equal to a maximum of 65 g/m2, more preferably to a maximum of 50 g/m2. Its density is typically below 0.6 g/cm3, preferably below 0.30 g/cm3 and more preferably between 0.08 and 0.20 g/cm3.

The production of tissue is distinguished from paper production by the its extremely low basis weight and its much higher tensile energy absorption index (see DIN EN 12625-4 and DIN EN 12625-5). Paper and tissue paper also differ in general with regard to the modulus of elasticity that characterizes the stress-strain properties of these planar products as a material parameter.

A tissue's high tensile energy absorption index results from the outer or inner creping. The former is produced by compression of the paper web adhering to a dry cylinder as a result of the action of a crepe doctor or in the latter instance as a result of a difference in speed between two wires ("fabrics"). This causes the still moist, plastically deformable paper web to be internally broken up by compression and shearing, thereby rendering it more stretchable under load than an uncreped paper.

Moist tissue paper webs are usually dried by the so-called Yankee drying, the through air drying (TAD) or the impulse drying method.

The fibers contained in the tissue paper are mainly cellulosic fibres, such as pulp fibers from chemical pulp (e.g. Kraft sulfite and sulfate pulps), mechanical pulp (e.g. ground wood), thermo mechanical pulp, chemo-mechanical pulp and/or chemo-thermo mechanical pulp (CTMP). Pulps derived from both deciduous (hardwood) and coniferous (softwood) can be used. The fibers may also be or include recycled fibers, which may contain any or all of the above categories. The fibers can be treated with additives—such as fillers, softeners, such as quaternary ammonium compounds and binders, such as conventional dry-strength agents or wet-strength agents used to facilitate the original paper making or to adjust the properties thereof. The tissue paper may also contain other types of fibers, e.g. regenerated cellulosic fibres or synthetic fibers enhancing, for instance, strength, absorption, smoothness or softness of the paper.

Tissue paper may be converted to the final tissue product in many ways, for example, by embossing or laminating it into a multi-ply product, rolled or folded.

The term non-woven (ISO 9092, DIN EN 29092) is applied to a wide range of products which, in terms of their properties, are located between those of paper (cf. DIN 6730, May 1996) and cardboard (DIN 6730) on the one hand, and textiles on the other hand. As regards non-woven a large number of extremely varied production processes are used, such as the air-laid and spun-laced techniques as well as wet-laid techniques. The non-woven includes mats, non-woven fabrics and finished products made thereof. Non-wovens may also be called textile-like composite materials, which represent flexible porous fabrics that are not produced by the classic methods of weaving warp and weft or by looping. In fact, non-wovens are produced by intertwining, cohesive or adhesive bonding of fibres, or a combination thereof. The non-woven material can be formed of natural fibres, such as cellulose or cotton fibres, but can also consist of synthetic fibres, such as Polyethylene (PE), polypropylene (PP), polyurethane (PU), polyester, nylon or regenerated cellulose, or a mix of different fibres. The fibres may, for example, be present in the form of endless fibres of pre-fabricated fibres of a finite length, as synthetic fibres produced in situ, or in the form of staple fibres. The nonwovens according to the invention may thus consist of mixtures of synthetic and cellulose fibrous material, e.g. natural vegetable fibres (see ISO 9092, DIN EN 29092).

Hygiene or wiping products primarily include all kind of dry-creped tissue paper, wet-creped paper and cellulose or pulp wadding or all kinds of nonwovens, or combinations, laminates or mixtures thereof. Typical properties of these hygiene and wiping products include the ready ability to absorb tensile stress energy, their drapability, good textile-like flexibility, properties which are frequently referred to as bulk softness, a high surface softness, and a high specific volume with a perceptible thickness. As high a liquid absorbency as possible and, depending on the application, a suitable wet and dry strength as well as an appealable visual appearance of the outer product surface is desired. These properties, among others, allow these hygiene and wiping products to be used, for example, as cleaning wipes such as paper or non-woven wipes, windscreen cleaning wipes, industrial wipes, kitchen paper, or the like; as sanitary products such as for example toilet paper, paper or non-woven handkerchiefs, household towels, towels, and the like; as cosmetic wipes such as for example facials and as serviettes or napkins, just to mention some of the products that can be used. Furthermore, the hygiene and wiping products can be dry, moist, wet or pre-treated in any manner. In addition, the hygiene and wiping products may be folded, interleaved or individually placed, stacked or rolled, connected or not, in any suitable manner.

Due to the above description, the products can be used for personal and household use as well as commercial and industrial use. They are adapted to absorb fluids, for decorative purposes, for packaging or even just as supporting material, as is common for example in medical practices or in hospitals. In terms of their wide variety, hygiene and wiping products are now considered to be everyday products.

BACKGROUND OF THE INVENTION

In general, hygiene paper products are known comprising a functional as well as a decorative structure. In particular, these hygiene paper products are printed and then embossed. In an additional step, the hygiene paper product, which is typically made in a continuous form, is cut to discrete lengths as desired so as to form a single sheet or perforations are provided to constitute a line of weakness that enables the consumer to separate a single sheet from a plurality of sheets which may be present in the form of a roll, e.g. a toilet roll or a kitchen roll. Between the treatments, namely printing, embossing and cutting/perforating there is generally, no synchronization. That is, the functional or decorative modifications of a continuous web during converting depend on certain repeat rates, which are generally predetermined by the equipment used and, thus, not the same.

For example, the repeat rate for the printing decoration may be 378 mm, i.e., the printing decor length is 378 mm and is repeated every 378 mm. However, the embossing pattern, for example, is repeated every 30 mm. Consequently, the position of the print to the embossing is different in every single sheet, as the repeat rates of these treatments do not match. The same occurs if the perforation repeat length (sheet length) is also different, that is in the above example 250 mm. Thus, the position of the print and the embossing is different on every sheet, as the perforation repeat length also does not match the other repeat lengths. This leads, as shown in FIG. 1, to print designs disturbed by embossing and perforations everywhere in the design. One sheet 1 of the hygiene paper product includes an embossed pattern 2 and printed pattern 3. Further, the sheet 1 is cut or perforated along a separation line 4. Because the repeat rates of the three elements embossing, printing and perforating do not match, e.g. the body of a printed animal interferes with the embossing and is partly cut or intersected, respectively, by the separation line 4.

In order to improve the optical appearance of the product, EP-A-0958112 discloses to synchronize or register one of the functional structures or the decorative structure with cutting or perforating. In this context, the spatial relationship between one pattern and the lines of termination (i.e. the line that separates one sheet from another either by means of a perforation or line of weakness or cutting) are set by adjusting either the rate of applying the pattern or the rate of applying the perforation or cutting, wherein the sheet is transported at a constant velocity.

U.S. Pat. No. 3,594,552 discloses a system and method for synchronizing single printing modules with each other. All used printing cylinders are rotated in unison at the same peripheral speed and the repeat rates of each printing cylinder are the same. Any failure in the synchronization is detected by a scanner detecting a reference mark on the web to be printed and, additionally, by a rotary, digital encoder. If an error is detected, it is corrected by means of a compensating device.

Thus, to enable two patterns to be in register, a pattern size, i.e., the length in the direction of movement of the web (in machine direction), needs to fit the respective processes. In typical state of the art equipment using a two-roll-combination, the pattern length of printing or embossing is predetermined by the roll diameters, roll circumferences or an integer number of the circumferences, respectively. For example, a typical roll circumference of a printing press is 756 mm. Consequently, the pattern length predetermined by the roll circumference can be selected from 756, 378 or 252, etc., i.e. the circumference divided by an integer number will define the repeat lengths. The maximum achievable repeat length is 756. The same considerations apply to embossing, where an engraved steel embossing roll with a certain diameter defines a maximum repeat length and the feasible integer divisions. For example, an embossing roll diameter of 530 mm having a circumference of 1664 mm may be used.

In theory, the chosen repeat lengths of both printing and embossing have to be identical to get a matched printing/embossing decoration. With the aforementioned roll dimensions, a print repeat of 75.6 mm (10 repeats per revolution) would match and be in register, respectively, with an embossing repeat of 75.6 (22 repeats per revolution). However, such theory is only applicable if certain process parameters are neglected.

In particular, converting a material web requires a web tension greater than 0 in order to pull the web forward and to control web tracking. In addition, the printing process, as well as the embossing process, requires and creates web speed that matches roll surface speeds. That is, there is no slip. Further, the web elongation within the printing and embossing process varies. Moreover, state of the art control systems control web tension, so that the stress-strain relation of the substrate is varied. Especially in the case of a highly stretchable tissue, this results in varying elongation at constant web tension. Thus, a minimum error/difference in repeat lengths or web elongation or speed will add up over time. For example, after 1000 repeats of the above example with 75.6 mm, even a small difference of some micrometers will add up after less than two minutes. FIG. 2 schematically illustrates such a mismatch, which is also called "walking off pattern".

SUMMARY OF THE INVENTION

In view of the above, it is the technical problem underlying the present invention to overcome the problems and theory of the prior art and to provide a method of manufacturing a hygiene paper product, being improved in its optical appearance in that the decorative structure and the functional structure are in register, as well as to provide an apparatus for such manufacture and a respective hygiene paper product.

The technical problem is solved by the subject matter defined in the independent claims. Further embodiments may be taken from the dependent claims.

According to the present invention, the method of manufacturing a hygiene paper product comprises the steps of providing a continuous paper web, moving the continuous web in a direction of its longitudinal extension, applying a repetitive decorative structure relative to the longitudinal extension of the web as a first pattern to the web by means of a first roll and applying a repetitive functional structure relative to the longitudinal extension of the web as a second pattern to the web by means of a second roll. So as to register the first pattern with the second pattern, that is, to phase the first pattern and the second pattern with respect to each other to have the same repetitive spatial relationship relative to each other along the entire longitudinal extension of the continuous web, the repetitive surface speed of the continuous web and the phasing between the first roll and the second roll are concurrently controlled. In other words, e.g., the surface speed of the continuous web in the first roll and/or the second roll can be controlled.

Preferably, the printing and embossing processes are positioned close to each other, wherein either the step of applying the decorative structure or the step of applying the functional structure is conducted downstream of the other step as seen in the direction of movement of the web. The downstream positioned process is setup with a fixed overspeed (for example 2%) and the equipment repeat rate (repeat length) of the two processes, namely the upstream step and the downstream step, differ by a fixed ratio adapted to and depending on the aforementioned overspeed. That is, the repeat lengths predetermined by the equipment of the two processes are chosen so that, under consideration of the overspeed, both applied structures are in register. The adjustment of the step of applying the decorative structure and the step of applying the functional structure so as to phase the first pattern and the second pattern relative to each other along the entire longitudinal extension of the continuous web, is performed by phase shifting by means of, for example, a gearbox or a servo drive.

In a preferred embodiment, the web elongation is controlled by an in-feed nip and an out-feed nip before and after the step of applying the first pattern and/or the step of applying the second pattern and relaxing the web after it leaves the out-feed nip. In particular, two additional nip points before and after one of the two processes create a defined and adjustable web elongation in this process and, thus, enable controlling of the surface speed of the continuous web in the process. Preferably, the nip point drives are coupled to the first or second roll, respectively. Thus, the web speed in these nip points is identical and the web passes the respective process without a change in tension or elongation. The web is relaxed after it leaves the out-feed nip. By this arrangement, for example, a print design with 200 mm repeat lengths on the printing roll can be printed on an elongated web. With, for example, a 5% elongation, the 200 mm print design will shrink to about 190 mm on the web after relaxation. This results in an adjustable repeat length, although the printing equipment and process as such are not adjustable. Consequently, within the context of elastic elongation, the system can also be used to correct a basic mismatch between the printing repeat lengths and any other repeat lengths, for example, embossing, perforation, etc. A typical range of adjustment for a tissue product will be 0% to 20%, preferably 0% to 10% and most preferred 0% to 5%. For example, a 0% to 5% range for a typical household towel will allow the adjustment of repeat lengths between 0 mm and 12 mm. By means of controlling the web elongation within one step compared to another step, the surface speed of the roll in the respective step can be controlled or influenced indirectly, by controlling the surface speed of the continuous web via the web elongation in the respective step.

Preferably, the method further comprises controlling of the speed ratio between the step of applying the first pattern and the step of applying the second pattern and the phasing between the step of applying the first pattern and the step of applying the second pattern by a feedback control of the position of the continuous web relative to a reference point. For example, a sensor, e.g. a camera detects a reference mark, preferably printed on the scrap part of the continuous web, and feeds back the difference between the target distance and the sensed distance between two marks. This signal can then be used to automatically correct the speed ratio of the drives of both processes. In addition, the correct phasing between the two processes can be controlled by this feedback control. Suitable feedback controls are generally known to the person skilled in the art so that a detailed description of same here is unnecessary.

Preferably, the method further comprises the step of repetitively perforating the continuous web transverse to its longitudinal extension and controlling the phasing between the perforating step and the step upstream of the perforating step, as seen in the direction of movement of the web, by means of the sensor, so as to phase perforations with the first pattern and/or the second pattern such as to have the same repetitive spatial relationship of the perforations relative to the first and/or the second pattern along the entire longitudinal extension of the continuous web. This method step is necessary, for example, if a hygiene paper product is to be produced that, as an end product, is present in the form of a roll of a plurality of separable sheets. Such a roll comprises a plurality of sheets separated by lines of weakness such as perforations. For example, the roll can have a total length of between 10 m and 20 m.

Preferably, the perforation of the continuous web is phased in a controlled manner by a sensor signal as described above as part of the feedback control. Perforating and cutting processes are rather uncritical in terms of speed, and are typically operated at an over-speed of 2% to 30% to achieve better sheer processes. Due to the speed flexibility, an automatically controlled phasing is sufficient to achieve a match of perforation to print and/or embossing.

In a preferred embodiment, in the step of applying the first pattern, the continuous web is printed, whereas in the step of applying the second pattern, the web is embossed. In particular, printing imparts the decorative structure, namely the design, whereas embossing imparts the functional structure, such as improving product thickness, absorbency, bulk softness, etc.

Moreover, during the step of applying the first pattern, a functional coating may be applied to the web. Functional coatings can be, for example, abrasive coatings to improve dry wiping capabilities of a towel. With the process described above, functional coating spots can be applied to defined areas of the product surface, e.g. only the peaks or valleys of an embossed product.

An apparatus for manufacturing a hygiene paper product comprises means for feeding a continuous paper web, means for moving the continuous web in a direction along its longitudinal extension, a first unit for applying a first pattern and a repetitive decorative structure to the paper, the first unit having a first roll, a second unit for applying a second pattern in a repetitive functional structure to the paper web, the second unit having a second roll. So as to phase the first pattern with respect to the second pattern such that they have the same repetitive spacial relationship relative to each other along the entire longitudinal extension of the continuous web, the apparatus further comprises means for concurrently controlling the surface speed of the continuous web and phasing between the first roll and the second roll.

Preferably, either the first unit or the second unit is located downstream of the other, as seen in the direction of movement of the continuous web, wherein both units are located close to each other. The downstream unit has a fixed surface overspeed, wherein a repeat rate of the upstream unit to a repeat rate of the downstream unit differs by a fixed ratio depending on the fixed surface over-speed. That is, the repeat length is selected or adjusted so as to theoretically enable bringing into register of both patterns, taking into account the difference in surface speed resulting from the overspeed. So as to phase the first pattern and the second pattern relative to each other, the apparatus further comprises means for phase shifting, wherein the means for phase shifting connects the drives of the upstream and the downstream units. The means for phase shifting may be a gearbox or a servo drive.

In a preferred embodiment, the apparatus further comprises two additional nip points, namely an in-feed nip and an out-feed nip upstream and downstream of one of the first or the second unit, as seen in the direction of movement of the continuous web, wherein the web is relaxed after leaving the out-feed nip. The nip points may be constituted by a driven S-wrap and the nip point drives may be coupled to the first or second roll, respectively. By this arrangement, the elongation of the web can be controlled within the respective unit before and after which the two nip points are located and, thus, indirectly the surface speed of the continuous web.

Preferably, the apparatus further comprises a feedback control of the position of the continuous web relative to a reference point so as to control the speed ratio between the first and second unit and/or the phasing therebetween.

Preferably, in order to produce a hygiene paper product in the form of a roll having a plurality of separable sheets, the apparatus further comprises a perforation unit for repetitively perforating the continuous web transverse to its longitudinal extension. The perforating unit is provided downstream of the first and/or second unit as seen in the direction of movement of the continuous web. For phasing between the perforation unit and the first and/or second unit a sensor is provided upstream of the perforating unit. The sensor may be part of the aforementioned feedback control, which detects a reference mark preferably printed on the scrap part of the paper web, and feeds back the difference between the target distance and the sensed distance between the two marks. The signal is then used to automatically control the phasing.

In a preferred embodiment, the first unit comprises a printing unit having a printing roll and the second unit comprises an embossing unit having an embossing roll.

The present invention further provides a product obtained by the aforementioned method or in the aforementioned apparatus.

The hygiene paper product of the present invention preferably has the form of a continuous web and comprises relative to the longitudinal web a first pattern with a repetitive decorative structure and a second pattern with a repetitive functional structure. The first pattern and/or the second pattern are positioned in a repetitive and adjustable position along the longitudinal extension of the web. That is, the respective pattern is repetitively positioned at a defined location on the web relative to a reference on the web such as, e.g., the perforations or the respective other pattern.

The inventive hygiene paper product has preferably the form of a continuous web being present in the form of a roll and comprises a first pattern having a repetitive decorative structure relative to the longitudinal extension of the web and the second pattern having a repetitive functional structure relative to the longitudinal extension of the web. The hygiene paper product is characterized in that the first pattern and the second pattern are registered or phased, respectively, with respect to each other such that they have the same repetitive spatial relationship relative to each other along the entire longitudinal extension of the continuous web.

Preferably, the hygiene paper product comprises a plurality of sheets detachably formed by perforations repetitively extending transverse to the longitudinal extension of the web, the perforations being registered or phased with respect to the first pattern and/or the second pattern so as to have the same repetitive spatial relationship relative to the first and/or the second pattern along the entire longitudinal extension of the continuous web.

For example, the first and the second patterns may be stripes transverse to the longitudinal extension of the web, wherein the first pattern and the second pattern do not overlap.

Alternatively, the first pattern may surround the second pattern and vice versa. For example, the first pattern is substantially uniformly distributed over substantially all the surface of the hygiene paper product and leaves a free space occupied by the second pattern.

Advantageously, the perforations do not intersect the first pattern and/or the second pattern. If the perforations are also in register with the first and second patterns, it is possible to obtain a hygiene paper product in which each sheet of a plurality of sheets, being separable by perforations, have the same visual appearance.

In a preferred embodiment, the first pattern is a printed pattern and the second pattern is an embossed pattern.

The present invention provides a great flexibility with respect to the visual design of hygiene paper products. With the present invention, it is possible to match different treatments or patterns, so that at the same time a hygiene paper product can be obtained which has an improved visual appearance, still provides the typical desired product characteristics and properties and which can easily be manufactured.

BRIEF DESCRIPTION OF THE DRAWINGS

The present invention is described and exemplified with reference to the accompanying drawings of preferred embodiments, in which the same parts bear the same reference numerals.

DETAIL DESCRIPTION OF THE INVENTION

Figure 3:
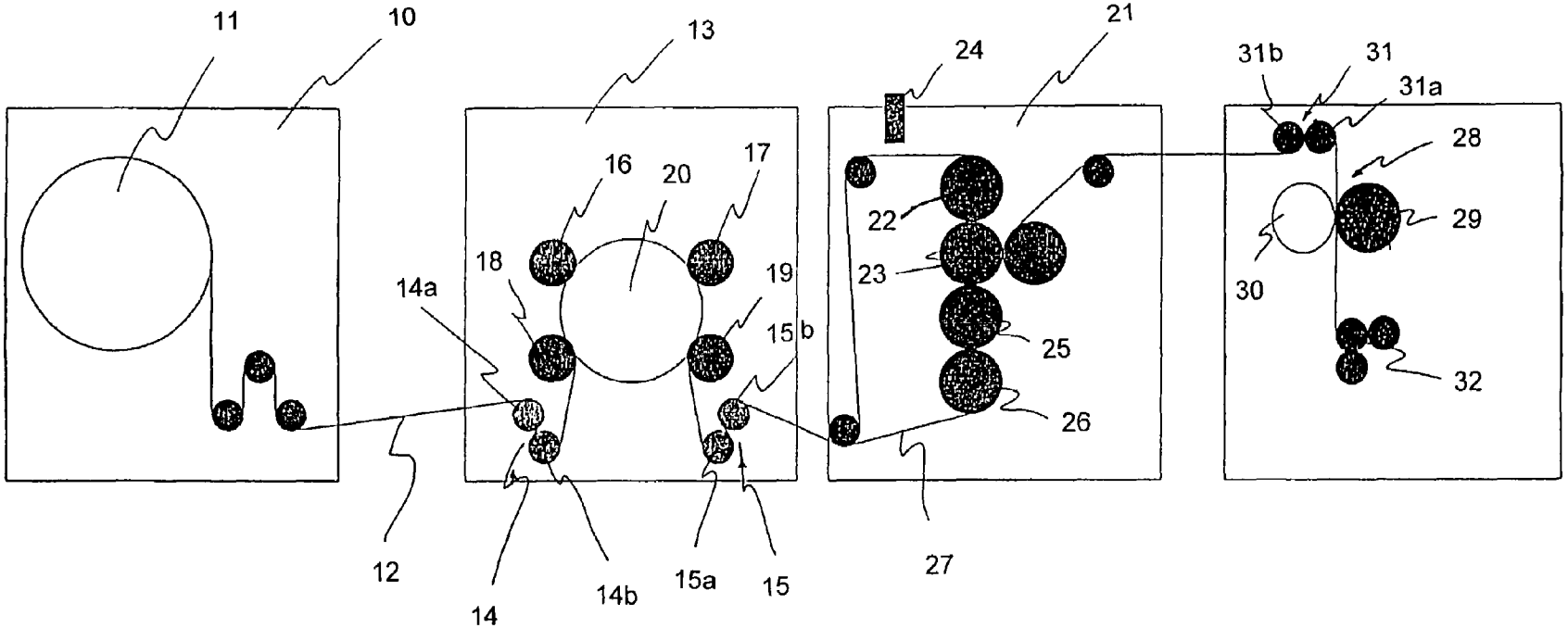
FIG. 3 is schematic view of a preferred embodiment of an apparatus according to the present invention, having a printing and an embossing unit.

FIG. 3 is a schematic view of an apparatus according to the present invention. The apparatus comprises an unwinder unit 10 for feeding a continuous paper web to the respective step of manufacture. In the unwinder unit 10 a parent roll 11 is unwound and fed into the respective unit in the form of a continuous paper web 12. The parent roll is a large roll of paper to be converted to multiple individual hygiene paper products in the form of sheets or rolls. Different parent rolls have different properties which effect the transport of the sheet through the apparatus. For example, the amount of stretch in the sheet as it travels through the apparatus frequently varies greatly between parent rolls. As these properties vary, so does the registration of the first pattern with the second pattern and/or the perforation. However, with the apparatus according to the present invention, this problem can be avoided.

In the shown example, a continuous web is first transported to a printing unit 13. Ahead of the printing unit, i.e. upstream of the printing unit as seen in the direction of movement of the web through the apparatus, an in-feed nip 14 in the form of a S-wrap is located and constituted by two rolls 14*a*, 14*b*. Beyond the printing unit 13, i.e., downstream of the printing unit, an out-feed nip 15 in the form of an S-wrap is located and also has two rolls 15*a* and 15*b*. The printing unit is located between the in-feed nip 14 and the out-feed nip 15 and comprises four printing cylinders 16, 17, 18 and 19 and one backing roll 20 for all four printing cylinders. As will be apparent, the printing unit 13 is a four colour printing unit and, thus, comprises the four printing cylinders. However, other conventional printing unit arrangements and with a different number of colors are also possible, as is evident to the skilled person. In the drawing, the continuous web is transported from the unwinder unit 10 to the printing unit 13, that is, the continuous web 12 moves from the left to the right as seen in the drawing. Consequently, as seen in the direction of movement of the continuous web 12, the in-feed nip 14 is located upstream of the printing unit and the out-feed nip 15 is located downstream of the printing unit.

After leaving the out-feed nip 15, the web is transported to the embossing unit 21. The embossing unit 21 comprises an embossing roll 22 and a respective backing roll 23. A sensor 24, which is part of a feedback control (not shown) is located above one surface of the web. The sensor 24 is located upstream of the embossing cylinder 22 as seen in the direction of movement of the web 12. The sensor 24 is capable of detecting a reference mark printed on the paper web, preferably by the printing unit 13 and, more preferably, on a scrap part of the web 12, which is cut to form in a later step. The feedback control calculates the difference between the target distance and the sensed distance between two reference marks on the paper web 12. Based on this signal, the speed ratio of the drive of the printing cylinders 16, 17, 18, 19 and the embossing cylinder 22 is adjusted, if required, to correct any deviations. Furthermore, the drives of the embossing cylinder 22 and the printing cylinder 16, 17, 18, 19 are connected via a gearbox or a master-slave servo drive.

As becomes apparent, the embossing unit 21 comprises a second embossing roll 25 and a second backing roll 26. For example, a second continuous web 27 may be fed to the embossing unit to be embossed and then laminated to the first continuous web 12 so as to enable the manufacture of a multi-ply paper product. Naturally, alternative arrangements of the embossing unit may be used and are well-known to the skilled person.

After embossing, the paper web is transported to a perforating unit 28 comprising a perforating roll 29 and a backing roll 30. An additional nip point 31, comprising two rolls 31*a* and 31*b* may be located upstream of the perforating unit 28. After perforation has been performed, the continuous web 12, or if two webs are laminated, the multi-ply web 27 is rewound by a rewinder unit 32. Thus, the end product can be provided in roll form such as for toilet paper rolls or a kitchen towel rolls. Alternatively, instead of the perforation unit, a cutting unit could be provided. In this case, the end product has the form of a single sheet such as, for example, napkins.

Figure 4:
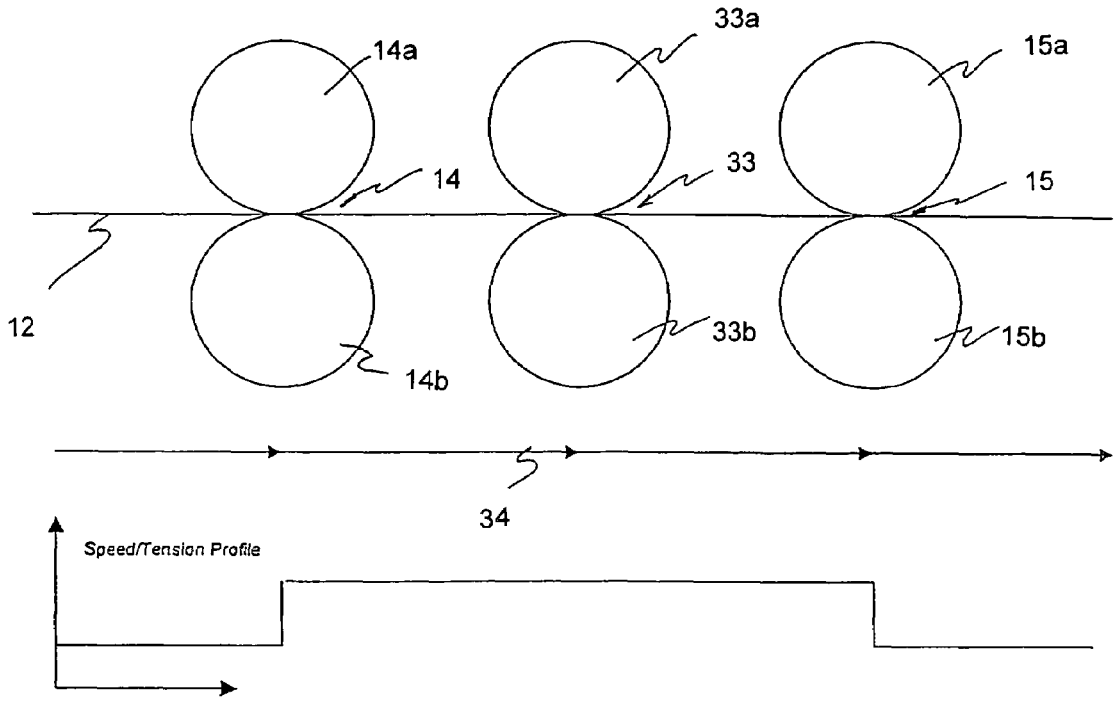
FIG. 4 is a schematic view of a unit of the inventive apparatus and having an in-feed nip and an out-feed nip, wherein the speed/tension profile is also shown.

Referring now to FIG. 4, this schematically shows the arrangement of an in-feed nip 14 and an out-feed nip 15 enclosing only one printing nip 33. The printing nip 33 is defined by a printing roll 33*a* and a backing roll 33*b*. The drive of all three nips 14, 15 and 33 are coupled and the web speed in these nip points is identical so that the web passes the process without a change in its tension or elongation. After leaving the out-feed nip 15, the web is relaxed.

As may be taken from the corresponding speed/tension profile shown in FIG. 4, a print design having, for example, 200 mm repeat lengths on the printing cylinders can be printed on an elongated web. The web is elongated between the in-feed nip and the out-feed nip and, after leaving the out-feed nip, it is again relaxed. With an elongation of 5%, the 200 mm print design, which is printed onto the so elongated web, will shrink to about 190 mm on the web after leaving the out-feed nip 15. Thus, within the context of elastic elongation, the system can also be used to correct a basic mismatch between printing repeat lengths and any other repeat lengths, such as in the preferred embodiment with embossing and/or perforating. A typical range of adjustment for a tissue product will be between 0% and 20%. As an example, a range of 0% to 5% for a typical household towel will allow the adjustment of a repeat length by between 0 mm and 12 mm. The elongation of the web 12 is adjusted by the drives of the respective nip points. The arrow 34 indicates the direction of movement of the web 12.

Figure 1:
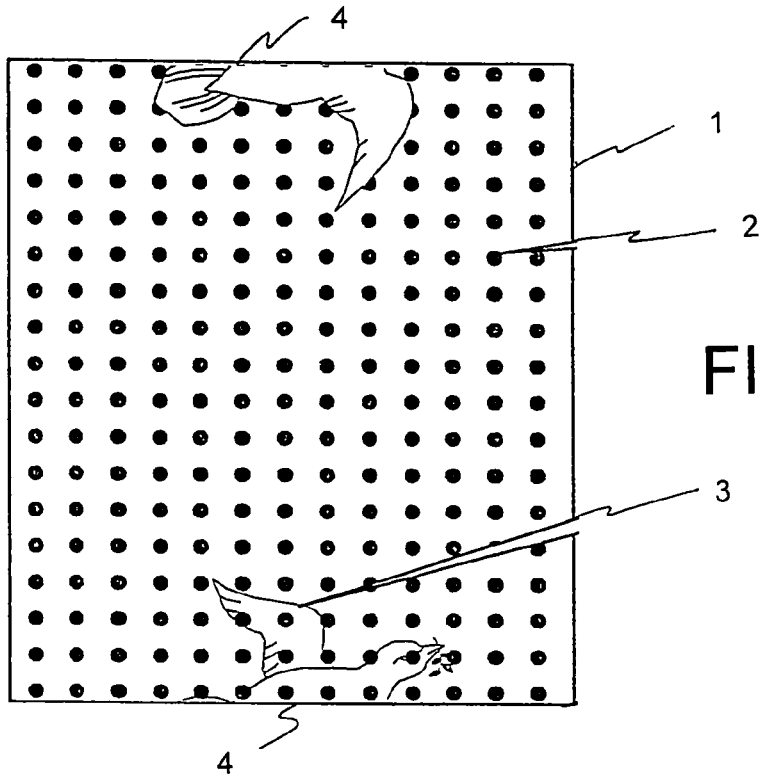
FIG. 1 shows one sheet of a hygiene paper product according to the prior art.
Figure 5:
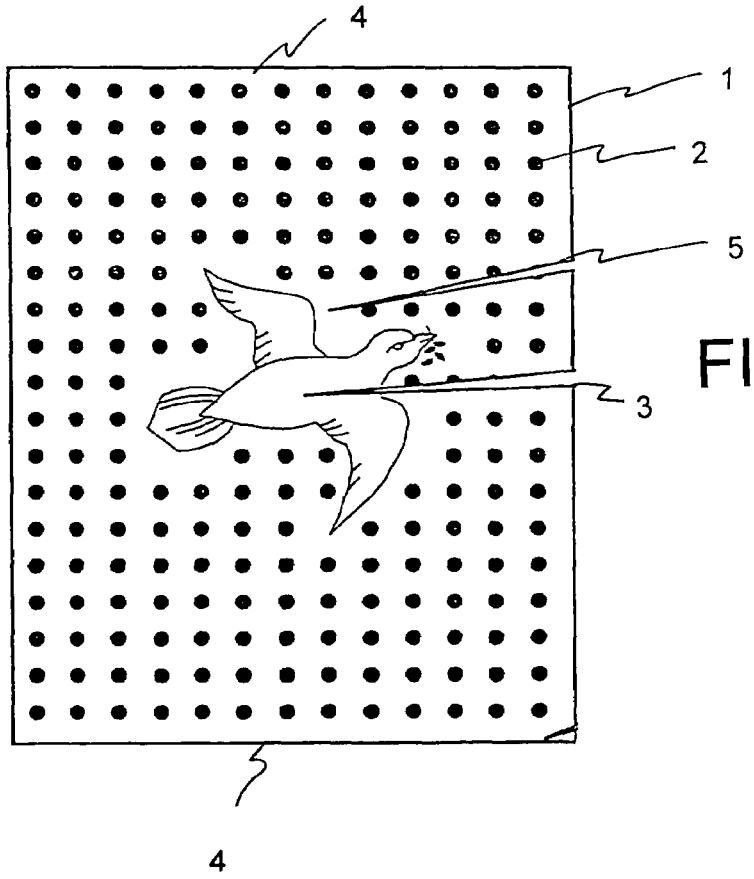
FIG. 5 is an exemplary embodiment of one sheet of a hygiene paper product according to the present invention.

In FIG. 5, one sheet of either a hygiene paper product in the form of a continuous web in roll form, or of a hygiene paper product being constituted by the sheet as such, is shown. The sheet 1 comprises a functional embossed pattern 2 and decorative printed pattern 3. As becomes apparent from FIG. 5, the pattern 2 and the pattern 3 are in register, that is both patterns match each other or are phased relative to each other. Further, the sheet is separated by cutting at the separation line 4 to provide perforations. Consequently, the present invention enables to repetitively produce sheets that have an embossed pattern 2 and a printed pattern 3 which are phased relative to each other such that it is possible to produce a plurality of sheets having repetitively the same spatial relationship of patterns relative to each other. In particular, the present invention enables to produce hygiene paper products in the form of a roll comprising a plurality of sheets being separated by perforations 4 transverse to the longitudinal extension of the web constituting the roll, wherein each sheet has the same spatial relationship between the embossed pattern 2 and the printed pattern 3 and wherein the perforations are made such that those patterns 2 and 3 repetitively have the same spatial relationship on the surface of a single sheet.

Figure 6:
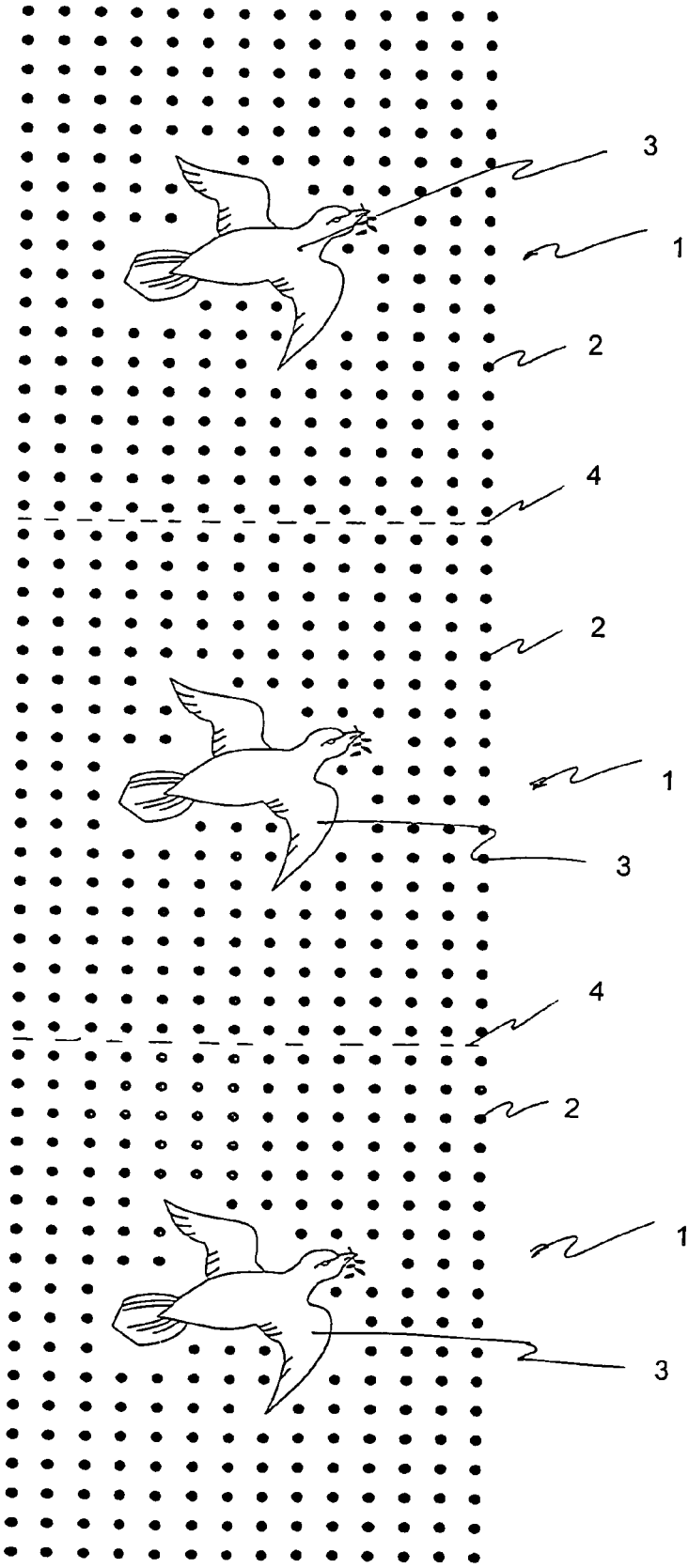
FIG. 6 shows an embodiment of a hygiene paper product according to the present invention in the form of a continuous web comprising a plurality of sheets being separable by means of perforations.

The aforementioned explanation becomes even more apparent from FIG. 6.

The operation of the apparatus according to the present invention will be described in more detail in the following. As becomes apparent from FIG. 3, the printing and embossing processes are positioned close to each other. As mentioned above, the drives of the printing unit, as well as the embossing unit, are connected by means of a phase shifting gearbox or electronically via master/slave servo drives. The embossing process is set-up with a fixed over-speed of, for example, 2%. That is, the surface speed of the embossing roll and the backing roll 23 and 22 is set-up with fixed over-speed. Further, the equipment repeat pattern of the two processes, that is, the repeat length of the printing process and the repeat length of the embossing process, differ by a fixed ratio adapted to the aforementioned over-speed. That is, the print repeat does not match the embossing repeat but both rates are adjusted with respect to the surface over-speed of the respective rolls. Further, the adjustment of the printing to the embossing pattern is performed by phase shifting via the gearbox or the servo drive.

Figure 2:
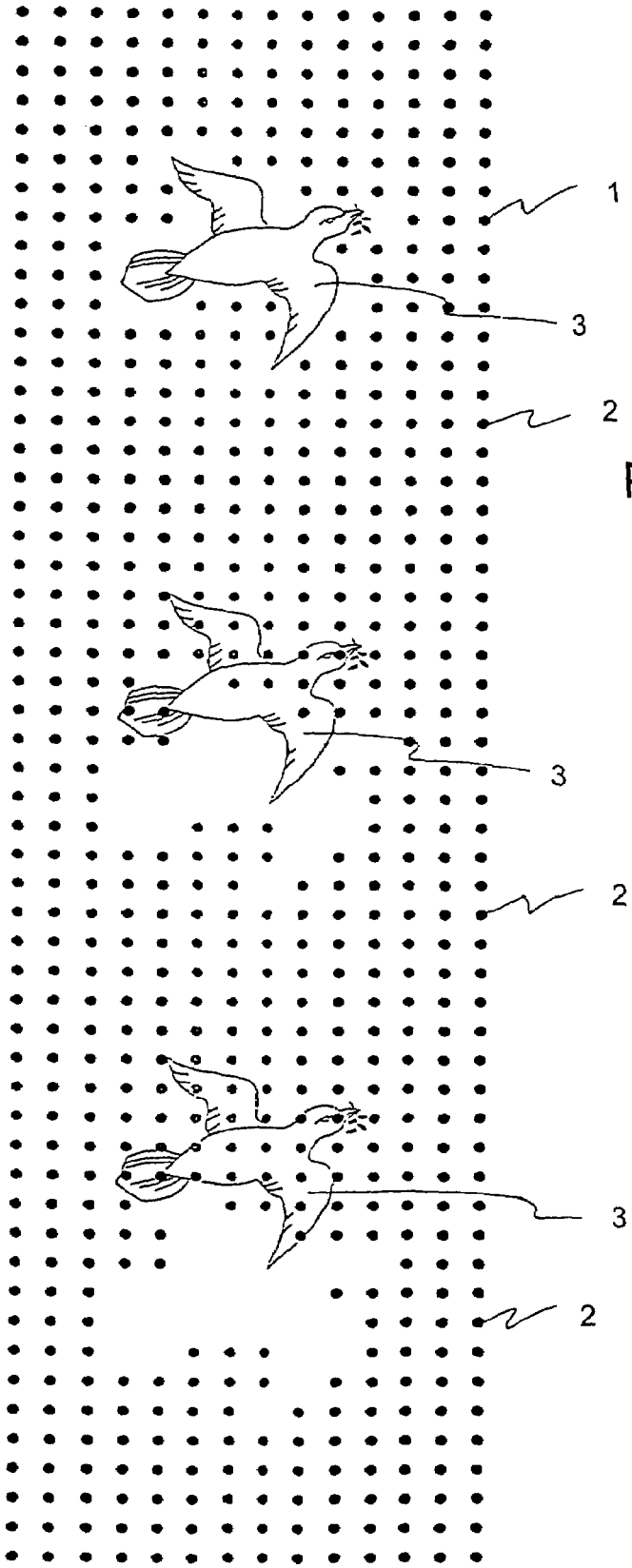
PRIOR ART FIG. 2
FIG. 2 shows the occurrence of "walking off" patterns in a continuous web of the prior art.

The fixed speed ratio goes along with a fixed web tension, the latter of which is not adjustable. However, different product specifications and raw materials, which are incorporated by means of the parent roll 11, require different web tensions for optimum product quality and trouble-free operation. Further, the fixed ratio also defines the repeat length difference between the printing and the embossing, as mentioned above. Nevertheless, any mistake in the repeat length will lead to "walking off"-patterns shown in FIG. 2. As it is difficult to exactly define the repeat lengths of a typical steel to rubber embossing unit, further adjustment is achieved according to the present invention by two additional nip points 14 and 15 arranged before and after the printing process. As become apparent from FIG. 3, the continuous paper web is fed to the printing unit 13 and enters an in-feed nip 14, runs through printing nips defined by the printing cylinders 16, 17, 18 and 19 and the backing roll 20, and then leaves the printing unit 13 via the out-feed nip 15. Between both the nips 14 and 15, the web elongations can be controlled so as to adjust the repeat length of the printing and the embossing processes. In fact, as mentioned above, by elongating the web 12 within the printing process, the repeat length of printing can be adjusted without adjusting the actual repeat length predetermined by the equipment, namely, the circumference of the printing rolls and the respective selection of the repeat lengths. For example, the print design with 200 mm lengths on the printing chlichés, that is the repeat lengths predetermined by the equipment, can be printed on an elongated web with an elongation of 5% of the web compared to its un-extended state such that the print design will shrink to about 190 mm on the web after relaxation, that is after the web 12 leaves the out-feed nip 15. The web elongation is adjusted by the drives of the nip points 14, 15 and 33, which are coupled.

Furthermore, during the printing process, a reference marks are printed at a predetermined spacing on the paper web. A sensor 24 detects the reference marks and the feedback control compares a target spacing to a sensed distance between two reference marks. Based on this signal, the speed ratios of the drives of the printing unit and the embossing unit are automatically corrected to ensure the desired phasing between the two patterns. By means of this feedback control, the correct elongation of the web in printing and embossing as well as phasing between the printing and the embossing can be automatically corrected and controlled.

Also the perforation of the tissue web is phase-controlled by the aforementioned sensor signal. Perforating and cutting processes are rather uncritical in terms of speed, wherein typical systems operate at an over-speed of 2% to 20% to achieve better sheer processing. Due to this speed flexibility, an automatically controlled phasing is sufficient to achieve a match of the perforation to the printing and/or embossing. That is, due to the signal received from the sensor and the feedback control, the speed of the perforating unit is merely adjusted so as to match the printing and/or the embossing.

Although the present invention has been described with reference to preferred embodiments, it is apparent to the skilled person that various modifications can be conducted without leaving the scope of the present invention defined in the appended claims.

The invention claimed is:

1. Method of manufacturing a hygiene paper product, the method comprising the steps of:

providing a continuous paper web;

moving the continuous web in a direction of its longitudinal extension;

applying a repetitive decorative structure relative to the longitudinal extension of the web as a first pattern to the web with a first roll;

applying a repetitive functional structure relative to the longitudinal extension of the web as a second pattern to the web with a second roll;

concurrently controlling the repetitive surface speed of the continuous web and the phasing between the first roll and the second roll so as to phase the first pattern and the second pattern with respect to each other to have the same repetitive spatial relationship relative to each other along the entire longitudinal extension of the continuous web; and controlling web elongation by an infeed nip and an outfeed nip before and after the step of applying the first pattern and/or the step of applying the second pattern and relaxing the web after it leaves the outfeed nip.

2. Method according to claim 1, further comprising conducting either the step of applying the decorative structure or the step of applying the functional structure downstream the other step as seen in the direction of movement of the web, performing the downstream step at a fixed surface overspeed of the respective roll, a repeat rate of the upstream step relative to a repeat rate of the downstream step differing by a fixed ratio depending on the overspeed, and phasing the first pattern and the second pattern relative to each other along the entire longitudinal extension of the continuous web by phase shifting.

3. Method according to claim 1, further comprising elongating the web within a range of between 0% and 20% of the longitudinal extension of the web in its un-tensioned state.

4. Method according to claim 1, further comprising controlling the speed ratio between the step of applying the first pattern and the step of applying the second pattern and the phasing between the step of applying the first pattern and the step of applying the second pattern by a feedback control of the position of the continuous web relative to a reference point.

5. Method according to claim 1, further comprising repetitively perforating the continuous web transverse to its longitudinal extension and controlling the phasing between the perforating step and the step upstream of the perforating step as seen in the direction of movement of the web with a sensor, so as to phase the perforations with the first pattern and/or the second pattern such as to have the same repetitive spatial relationship of the perforations relative to the first and/or the second pattern along the entire longitudinal extension of the continuous web.

6. Method according to claim 1, further comprising printing the web in the step of applying the first pattern, and embossing the web step of applying the second pattern.

7. Method according to claim 1, further comprising applying a functional coating to the web during the step of applying the first pattern.

8. Apparatus for manufacturing a hygiene paper product, comprising:

means for feeding a continuous paper web, means for moving the continuous web in a direction along its longitudinal extension;

a first unit for applying a first pattern in a repetitive decorative structure to the paper web, the first unit having a first roll;

a second unit for applying a second pattern in a repetitive functional structure to the paper web, the second unit having a second roll;

means for concurrently controlling the surface speed of the continuous web and phasing between the first roll and the second roll so as to phase the first pattern with respect to the second pattern such that they have the same repetitive spatial relationship relative to each other along the entire longitudinal extension of the continuous web; and a perforation unit for repetitively perforating the continuous web transverse to its longitudinal extension, the perforating unit being provided downstream of the first and/or second unit as seen in the direction of movement of the continuous web and a sensor for controlling the phasing between the perforating unit and the first and/or second unit upstream the perforating unit.

9. Apparatus according to claim 8, wherein either the first unit or the second unit is located downstream of the other as seen in the direction of movement of the continuous web, and the downstream unit has a fixed surface overspeed, a repeat rate of the upstream unit to a repeat rate of the downstream unit differing by a fixed ratio depending on the fixed surface overspeed, and wherein the apparatus further comprises a means for phase shifting the first pattern and the second pattern relative to each other, the means for phase shifting connecting drives of the upstream and the downstream unit.

10. Apparatus according to claim 8, wherein for controlling web elongation the apparatus further comprises an infeed nip and an outfeed nip upstream and downstream of one of the first unit or the second unit as seen in the direction of movement of the continuous web, whereby the web is relaxed after leaving the outfeed nip.

11. Apparatus according to claim 8, further comprising a feedback control of the position of the continuous web relative to a reference point for controlling the speed ratio between the first unit and the second unit and/or the phasing therebetween.

12. Apparatus according to claim 8, wherein the first unit comprises a printing unit having a printing roll and the second unit comprises an embossing unit having an embossing roll.

* * * * *